US010718538B2

(12) United States Patent
Liu et al.

(10) Patent No.: US 10,718,538 B2
(45) Date of Patent: Jul. 21, 2020

(54) METHOD AND DEVICE FOR OBTAINING A WATER AMOUNT FOR A HUMIDIFIER

(71) Applicants: Beijing Xiaomi Mobile Software Co., Ltd., Beijing (CN); Beijing Smartmi Technology Co., Ltd., Beijing (CN)

(72) Inventors: Tiejun Liu, Beijing (CN); Xingsheng Lin, Beijing (CN); Yanan Meng, Beijing (CN); Dongdong Wang, Beijing (CN)

(73) Assignees: Beijing Xiaomi Mobile Software Co., Ltd., Beijing (CN); Beijing Smartmi Technology Co., Ltd., Beijing (CN)

( * ) Notice: Subject to any disclaimer, the term of this patent is extended or adjusted under 35 U.S.C. 154(b) by 99 days.

(21) Appl. No.: 15/700,715

(22) Filed: Sep. 11, 2017

(65) Prior Publication Data

US 2018/0073758 A1 Mar. 15, 2018

(30) Foreign Application Priority Data

Sep. 14, 2016 (CN) ..... 2016 1 0827278

(51) Int. Cl.
*F24F 11/50* (2018.01)
*F24F 11/00* (2018.01)
(Continued)

(52) U.S. Cl.
CPC ..... *F24F 11/30* (2018.01); *F24F 3/14* (2013.01); *F24F 6/00* (2013.01); *F24F 6/12* (2013.01);
(Continued)

(58) Field of Classification Search
CPC ..... F24F 6/00; F24F 2006/008; F24F 6/12; F24F 11/0008; F24F 2110/20;
(Continued)

(56) References Cited

U.S. PATENT DOCUMENTS

2014/0151456 A1* 6/2014 McCurnin ..... G05D 23/1905 236/51
2014/0346688 A1* 11/2014 Darwinkel ..... F24F 6/00 261/128

FOREIGN PATENT DOCUMENTS

CN 2767887 Y 3/2006
CN 103328031 A 9/2013
(Continued)

OTHER PUBLICATIONS

Hollaway, Martin: How to Use the Psychrometric Chart: The psychrometric chart provides quick answers to questions that would be take longer to calculate if you had to use a formula. Retrieved from https://www.greenbuildingadvisor.com/article/how-to-use-the-psychrometric-chart (Year: 2014).*
(Continued)

*Primary Examiner* — Jianying C Atkisson
*Assistant Examiner* — Daniel C Comings
(74) *Attorney, Agent, or Firm* — Finnegan, Henderson, Farabow, Garrett & Dunner, L.L.P.

(57) ABSTRACT

A method for obtaining a water amount for a humidifier, includes: obtaining a target humidification parameter for a space to be humidified; determining a water amount required for the humidifier to reach the target humidification parameter; and outputting a notifying message, the notifying message carrying the determined water amount.

18 Claims, 14 Drawing Sheets

(51) Int. Cl.

| | |
|---|---|
| ***F24F 11/30*** | (2018.01) |
| ***F24F 11/62*** | (2018.01) |
| ***F24F 3/14*** | (2006.01) |
| ***F24F 6/00*** | (2006.01) |
| ***F24F 6/12*** | (2006.01) |
| *F24F 110/20* | (2018.01) |

(52) U.S. Cl.
CPC ..... *F24F 11/0008* (2013.01); *F24F 11/62* (2018.01); *F24F 11/50* (2018.01); *F24F 2006/008* (2013.01); *F24F 2110/20* (2018.01)

(58) Field of Classification Search
CPC .. F24F 1/037; F24F 11/49; F24F 11/50; F24F 11/52; F24F 2010/20
See application file for complete search history.

(56) References Cited

FOREIGN PATENT DOCUMENTS

| | | | | | |
|---|---|---|---|---|---|
| CN | 204026929 | U | | 12/2014 | |
| CN | 104315662 | A | | 1/2015 | |
| CN | 104315664 | A | | 1/2015 | |
| CN | 104896674 | A | | 9/2015 | |
| CN | 105180300 | A | | 12/2015 | |
| CN | 205119362 | U | | 3/2016 | |
| CN | 105650795 | A | | 6/2016 | |
| CN | 105650979 | A | | 6/2016 | |
| CN | 105751685 | A | | 7/2016 | |
| CN | 105783177 | A | | 7/2016 | |
| CN | 106403123 | A | | 2/2017 | |
| EP | 2492603 | A2 | | 8/2012 | |
| GB | 2323943 | A | | 10/1998 | |
| JP | H8-28935 | A | | 2/1996 | |
| JP | H 1128201 | A | | 9/1999 | |
| JP | 2002005492 | A | | 1/2002 | |
| JP | 2006-162167 | A | | 6/2006 | |
| JP | 2006162167 | A | * | 6/2006 | |
| JP | 2006226554 | A | | 8/2006 | |
| JP | 2008-170401 | A | | 7/2008 | |
| JP | 2008298358 | A | | 12/2008 | |
| JP | 2009-138978 | A | | 6/2009 | |
| JP | 2014-74571 | A | * | 4/2014 | ..... F24F 6/00 |
| KR | 19980085052 | A | | 12/1998 | |
| WO | WO 2009/076283 | A1 | | 6/2009 | |
| WO | WO 2012/100291 | A1 | | 8/2012 | |
| WO | WO 2014/066882 | A1 | | 5/2014 | |

OTHER PUBLICATIONS

Mustafa, Ayad: Experimental Study of Air Flow Rate Effects on Humidification Parameters With Preheating and Dehumidification Process Changing. Retrieved from Asian Research Publishing Network (Year: 2011).*

Extended European Search Report issued in European Patent Application No. 17190666.2, mailed from the European Patent Office, dated Dec. 19, 2017.

International Search Report issued in International Application No. PCT/CN2016/111349, mailed from the State Intellectual Property Office of China dated May 31, 2017.

English version of International Search Report issued in International Application No. PCT/CN2016/111349, mailed from the State Intellectual Property Office of China dated May 31, 2017.

Office Action for Russian Application No. 2017109445/12, dated Apr. 28, 2018.

* cited by examiner

METHOD AND DEVICE FOR OBTAINING A WATER AMOUNT FOR A HUMIDIFIER

CROSS-REFERENCE TO RELATED APPLICATIONS

This application is based upon and claims priority to Chinese Patent Application No. 201610827278.5, filed on Sep. 14, 2016, the entire contents of which are incorporated herein by reference.

TECHNICAL FIELD

The present disclosure relates to the field of smart home appliances, and more particularly, to a method and a device for obtaining a water amount for a humidifier.

BACKGROUND

Humidifiers are widely used in people's daily life. An air humidifier is enabled to operate when water is added to a tank of the humidifier by a user, and the humidifier may convert the water in the tank into water mist and spread the water mist into air through a pneumatic device. Thus air humidity can be increased, and fresh air is provided.

SUMMARY

According to a first aspect of the present disclosure, there is provided a method for obtaining a water amount for a humidifier, comprising: obtaining a target humidification parameter for a space to be humidified; determining a water amount required for the humidifier to reach the target humidification parameter; and outputting a notifying message, the notifying message carrying the determined water amount.

According to a second aspect of the present disclosure, there is provided a device for obtaining a water amount for a humidifier, comprising: a processor; and a memory for storing instructions executable by the processor, wherein the processor is configured to: obtain a target humidification parameter for a space to be humidified; determine a water amount required for the humidifier to reach the target humidification parameter; and output a notifying message, the notifying message carrying the determined water amount.

According to a third aspect of the present disclosure, there is provided a non-transitory computer-readable storage medium having stored therein instructions that, when executed by a processor of a device, cause the device to perform a method for obtaining a water amount for a humidifier, the method comprising: obtaining a target humidification parameter for a space to be humidified; determining a water amount required for the humidifier to reach the target humidification parameter; and outputting a notifying message, the notifying message carrying the determined water amount.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Exemplary embodiments will now be described in detail, examples of which are illustrated in the accompanying drawings. The following description refers to the accompanying drawings, in which like numerals refer to the same or similar elements unless otherwise indicated. The implementations described in the following exemplary embodiments do not represent all implementations consistent with the present disclosure. Rather, they are merely examples of devices and methods consistent with some aspects of the present disclosure as detailed in the appended claims.

A user may not clearly know how much water to add to a tank of a humidifier when the user uses the humidifier. If the added water is not enough, the added water inside the tank will run out soon. However, if excessive water is added, extra water will be left in the tank after the use, which may result in formation of scale.

In exemplary embodiments of the present disclosure, when the humidifier is used, a target humidification parameter for a space to be humidified is firstly obtained, a water amount required for the humidifier to reach the target humidification parameter is then determined, and a notifying message is further output to notify the user of the water amount required for the humidifier to reach the target humidification parameter, which facilitates the user to add water into the tank and reduces damage to the humidifier caused by an inappropriate amount of water in the humidifier.

Figure 1:
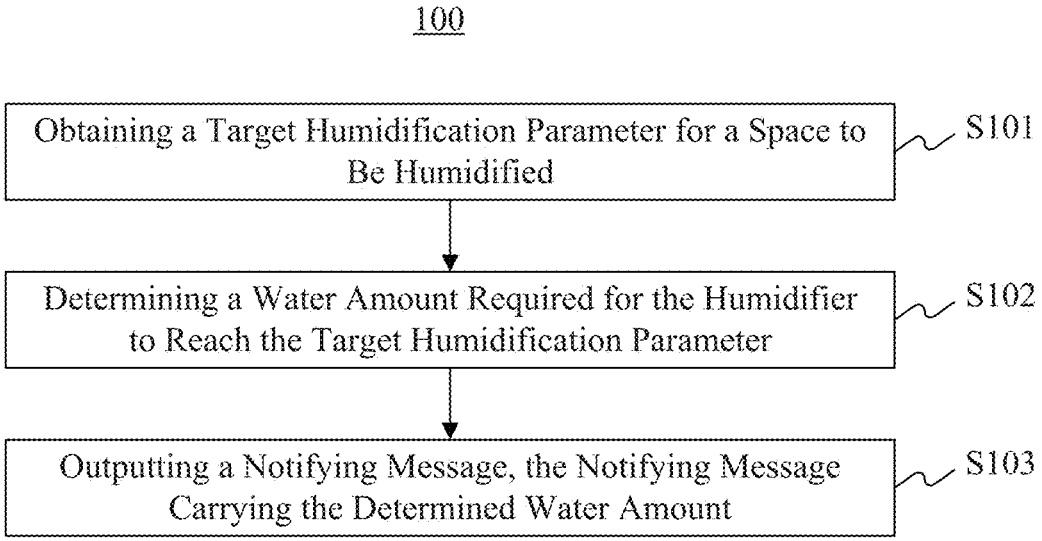
FIG. 1 is a flow diagram of a method for obtaining a water amount for a humidifier in accordance with an exemplary embodiment.

FIG. 1 is a flow diagram of a method 100 for obtaining a water amount for a humidifier in accordance with an exemplary embodiment. For example, the method 100 may be used in a terminal. Referring to FIG. 1, the method 100 includes the following steps S101-S103.

In step S101, a target humidification parameter for a space to be humidified is obtained.

In step S102, a water amount required for the humidifier to reach the target humidification parameter is determined.

In step S103, a notifying message is output, the notifying message carrying the determined water amount.

In the exemplary embodiment, the terminal is provided with a humidifier control application (APP), and the terminal can obtain the target humidification parameter input by a user via a user interface provided by the humidifier control APP. When the user wants to use the humidifier to humidify a space to be humidified such as a living room, a bedroom, an office and the like, the user can activate the humidifier control APP in the terminal and input the desired target humidification parameter on the user interface provided by the humidifier control APP. Thus the terminal obtains the target humidification parameter for the space to be humidified.

In some embodiments, the terminal may determine the target humidification parameter automatically based on the user's body data, environmental data of the space to be humidified and so on.

In the exemplary embodiment, the terminal calculates the water amount required for the humidifier to reach the target humidification parameter after obtaining the target humidification parameter, and then the terminal outputs the notifying message carrying the water amount to notify the user of the water amount required for the humidifier to reach the target humidification parameter.

In exemplary embodiments, the target humidification parameter includes at least one of a target humidity or a target humidification time.

Figure 2:
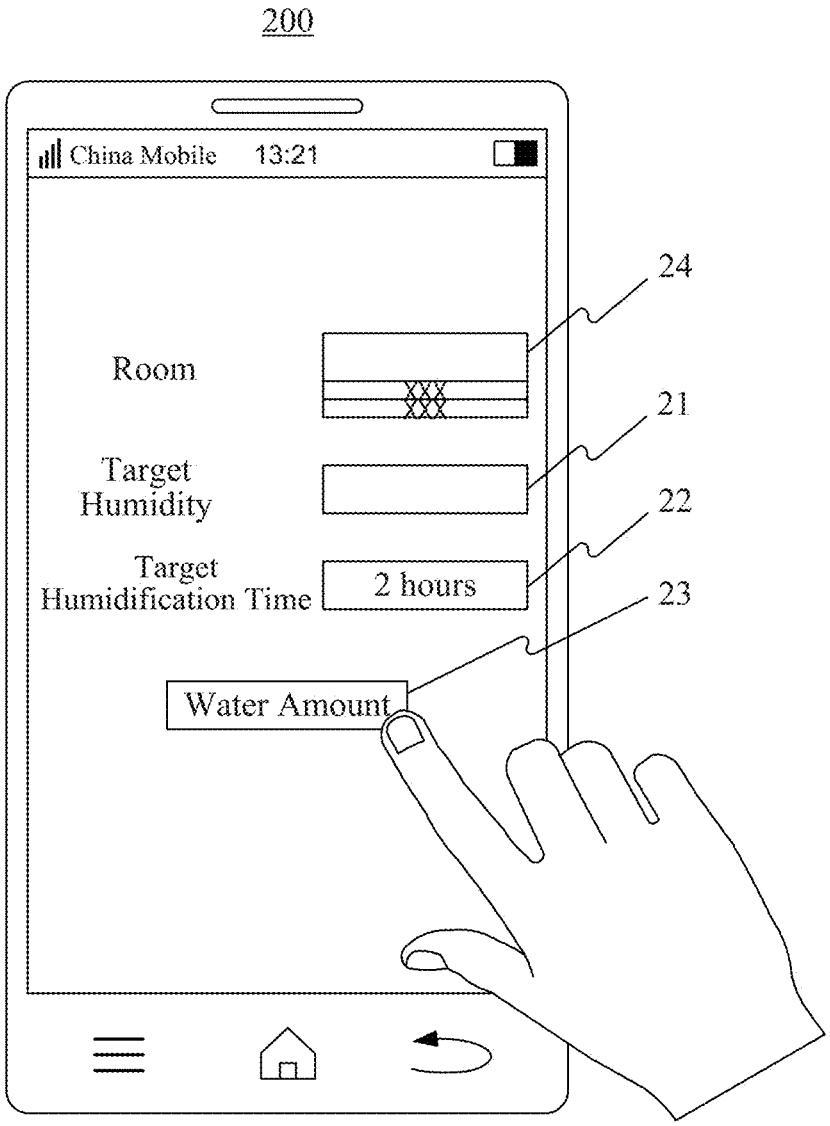
FIG. 2 is a schematic diagram of a user interface provided by a humidifier control application in a terminal in accordance with an exemplary embodiment.

FIG. 2 is a schematic diagram of a user interface 200 of the humidifier control APP in the terminal, according to an exemplary embodiment. Referring to FIG. 2, the user may input a humidity value, such as 50% RH (relative humidity), as the target humidity in a target humidity input box 21, or input a time value, such as 2 hours, as the target humidification time in a target humidification time input box 22. In some embodiments, the user may input a time, such as four o'clock in the afternoon, in the target humidification time input box 22, based on which the terminal calculates a time period from a current time to four o'clock in the afternoon as the target humidification time.

In the exemplary embodiment, the target humidification parameter can be at least one of the target humidity or the target humidification time, based on the needs of the user. When the user needs to use the humidifier during a period when the user stays in the space to be humidified, the target humidification time can be set as the target humidification parameter. When the user needs the humidity in the space to be in a certain range, the user can set the target humidity as the target humidification parameter.

After obtaining the target humidity, the terminal may calculate the water amount required for the humidifier to humidify the space to be humidified to the target humidity. Alternatively, after obtaining the target humidification time, the terminal may calculate the water amount required for the humidifier to humidify the space for the target humidification time.

In the exemplary embodiment in FIG. 2, after the user inputs the target humidification parameter such as the target humidification time of two hours, and presses or touches a button "Water Amount" 23, the terminal starts to calculate the water amount required for the humidifier to humidify the space for two hours.

The terminal may also determine the target humidification parameter automatically based on the user's body data, environmental data of the space to be humidified and so on. As an example, the target humidification parameter is the target humidity, and if the user is in good health and the temperature of the space to be humidified is 25° C., the terminal determines the target humidity as 50% RH.

In some embodiments, a plurality of target humidification parameters can be used to determine the water amount to satisfy the user's various target humidification demands.

In an embodiment, when the target humidification parameter is the target humidity, step S102 includes steps A1 and A2. In step A1, an area and a current humidity of the space to be humidified are obtained. In step A2, the water amount required for the humidifier to reach the target humidity is determined in accordance with the area, the current humidity, and the target humidity of the space to be humidified.

In the exemplary embodiment, the terminal obtains the area of the space to be humidified based on the user's input. As an example, the area for each room to be humidified, such as a living room, a bedroom, and a study room, is input by the user and pre-stored in the terminal. For example, as shown in FIG. 2, a room option 24 may be provided on the user interface 200 of the humidifier control APP, and if the user wants to humidify the study room, the user can select the "study room" in the room option 24, and the terminal can obtain the area of the study room. Alternatively and/or additionally, a room area input box (not shown) may be provided on the user interface 200 of the humidifier control APP, and if the user wants to humidify the bedroom, the user can input the area of the bedroom in the room area input box, and the terminal will use the input area as the area of the space to be humidified.

In some embodiments, the terminal obtains the area of the space to be humidified by its own measurement. As an example, the terminal uses a camera to take pictures of the space to be humidified at various angles, obtains a length and a width of the space to be humidified by performing image analysis on the pictures of the space to be humidified, and then calculates the area of the space to be humidified. In some embodiments, the terminal obtains distances from the terminal to the front, back, left and right sides of the space to be humidified by infrared or laser distance measurement, calculates the length and the width of the space to be humidified, and then obtains the area of the space to be humidified.

In an exemplary embodiment, the terminal obtains the current humidity of the space to be humidified using a humidity sensor.

In an exemplary embodiment, if the current humidity and the target humidity are fixed, i.e., a humidity to be increased is fixed, the larger the area of the space to be humidified is, the greater the water amount required for the humidifier is; and if area of the space to be humidified is fixed, the greater the humidity to be increased is, the greater the water amount required for the humidifier is. Accordingly, there is a functional relationship between the area, the current humidity, and the target humidity of the space to be humidified, and the water amount required for the humidifier, and the terminal can obtain the functional relationship between the area, the current humidity, and the target humidity of the space to be humidified and the water amount required for the humidifier through a statistical analysis of a large amount of test data. The terminal can then determine the water amount required for the humidifier to reach the target humidity in accordance with the area, the current humidity, and the target humidity of the space to be humidified based on the functional relationship.

In the exemplary embodiment, the water amount required for the humidifier can be accurately determined from the area, the current humidity and the target humidity of the space to be humidified, thereby reducing damage to the humidifier caused by an inappropriate amount of water in the humidifier.

In an embodiment, step A2 includes: determining the water amount required for the humidifier to reach the target humidity according to the following formula: $V=(t_1-t_0)*s*w_1$, wherein V is the determined water amount, $t_1$ is the target humidity, $t_0$ is the current humidity, s is the area of the space to be humidified, and $w_1$ is a predetermined coefficient.

The predetermined coefficient $w_1$ is the water amount required to increase a unit humidity per unit area, and the predetermined coefficient $w_1$ can be obtained based on a statistical analysis of a large amount of test data and pre-stored in the terminal.

Therefore, the terminal can determine the water amount required for the target humidity through the formula of $V=(t_1-t_0)*s*w_1$ based on the area, the current humidity $t_0$, and the target humidity $t_1$ of the space to be humidified.

In some embodiments, based on a statistical analysis of a large amount of test data, the terminal obtains the water amount required per unit area for each increased unit of humidity when the area is within a first area range and an increase in the humidity is within a first humidity range; obtains the water amount required per unit area for each increased unit of humidity when the area is within a second area range and the increase in the humidity is within the first humidity range; and obtains the water amount required per unit area for each increased unit of humidity when the area is within the first area range and the increase in the humidity is within a second humidity range; and so on. In this way, the terminal determines in advance a correspondence between the area range and the humidity range, and the water amount required per unit area for each increased unit of humidity within the area range and the humidity range. Then, during an actual operation, the terminal selects a water amount required per unit area for each increased unit of humidity based on the correspondence, and calculates the product of the selected water amount required per unit area for each increased unit of humidity, the obtained area of the space to be humidified, and a humidity difference (i.e. target humidity—current humidity) as the water amount required for the humidifier.

It is to be noted that the functional relationship between the area, the current humidity, the target humidity of the space to be humidified and the water amount required for the humidifier obtained by the terminal may be in other relationships, and is not limited to the linear relationship (i.e., $V=(t_1-t_0)*s*w_1$) given in the exemplary embodiment.

In an embodiment, when the target humidification parameter is the target humidification time, step S102 includes steps B1 and B2. In step B1, a motor speed of the humidifier is obtained. In step B2, the water amount required for the humidifier to reach the target humidification time is determined in accordance with the motor speed and the target humidification time.

In the exemplary embodiment, the motor of the humidifier blows water mist out of the humidifier, and the terminal can obtain the motor speed of the humidifier based on the user's input. As an example, the motor speed of the humidifier may be at one fixed level, which is not adjustable, or also may have an adjustable plurality of levels. The motor speeds corresponding to the respective levels may be input by the user and pre-stored in the terminal. If the motor speed of the humidifier has one level, the terminal can directly obtain the motor speed of the humidifier at the target humidification time. If the motor speed of the humidifier has a plurality of adjustable levels, when the user places the humidifier in the bedroom for humidification, for example, a level option for the motor speed is provided on the user interface 200 of the humidifier control APP. The user can select the level of the motor speed which is to be used by the humidifier for humidification, and then the terminal obtains the motor speed corresponding to the selected level.

When the motor speed is greater, there is more water mist spread into the space to be humidified by the humidifier in a unit time. In this case, if the humidification time is fixed, the greater the motor speed is, the more the water amount required for the humidifier is; and if the motor speed is fixed, the longer the humidification time is, the more the water amount required for the humidifier is. Accordingly, there is a functional relationship between the motor speed and the target humidification time, and the water amount required for the humidifier, and the terminal can obtain the functional relationship between the motor speed and the target humidification time, and the water amount required for the humidifier through a statistical analysis of a large amount of test data. In this way, the terminal determines the water amount required for the humidifier to reach the target humidification time in accordance with the motor speed and the target humidification time based on the functional relationship.

In the exemplary embodiment, the water amount required for the humidifier can be accurately determined from the motor speed and the target humidification time, thereby reducing damage to the humidifier caused by an inappropriate amount of water in the humidifier.

In an embodiment, step B2 includes: determining the water amount required for the humidifier to reach the target humidification time according to the following formula: $V=t*v*w_2$, wherein V is the determined water amount, t is the target humidification time, v is the motor speed, and $w_2$ is a predetermined coefficient. The predetermined coefficient $w_2$ is the water amount required per unit of humidification time at a rotational speed, and the predetermined coefficient $w_2$ can be obtained based on a statistical analysis of a large amount of test data and pre-stored in the terminal.

In some embodiments, based on a statistical analysis of a large amount of test data, the terminal obtains the water amount required per unit of humidification time at a unit rotational speed when the motor speed is within a first rotational speed range and the target humidification time is within a first period range; obtains the water amount required per unit of humidification time at a unit rotational speed when the motor speed is within the first rotational speed range and the target humidification time is within a second period range; and so on. In this way, the terminal determines in advance a correspondence between the rotational speed range and the period range, and the water amount required per unit of humidification time at a unit rotational speed. Then, during an actual operation, the terminal selects a water amount required per unit of humidification time at a unit rotational speed based on the correspondence, and calculates the product of the selected water amount required per unit of humidification time at a unit rotational speed, the obtained motor speed, and the target humidification time, as the water amount required for the humidifier.

It is to be noted that the functional relationship between the motor speed, the target humidification time, and the water amount required for the humidifier obtained by the terminal may be other relationships, and is not limited to the linear relationship (i.e., $V=t*v*w_2$) given in the exemplary embodiment.

In an embodiment, step S103 includes step C1, in which the determined water amount is displayed.

For example, the tank of the humidifier is provided with a water mark. When the water amount required for the humidifier to reach the target humidification parameter is determined, the terminal can output and display the water amount. The user can then add water in the tank of the humidifier to the displayed water amount in accordance with the water mark provided on the tank of the humidifier, which facilitates the user to add water into the tank.

In an embodiment, step S103 includes step D1, in which the notifying message is sent to the humidifier, to cause the humidifier to output a reminder message when the water in the tank of the humidifier reaches the water amount.

In the exemplary embodiment, when the water amount required for the humidifier to reach the target humidification parameter is determined, the terminal directly sends the determined water amount, carried in the notifying message, to the humidifier. A pressure sensor is provided in the humidifier, and if the pressure sensor in the humidifier detects that an amount of water in the humidifier reaches the determined water amount when the user adds water to the humidifier, the pressure sensor outputs the reminder message.

The reminder message may be vibration information, sound information or the like. As an example, a buzzer may be provided in the humidifier, and when the pressure sensor in the humidifier detects that the amount of water in the humidifier reaches the water amount, the pressure sensor sends an electrical signal to the buzzer. Then, the buzzer beeps, to remind the user to stop adding water, which further facilitates the user to add water into the tank.

In some embodiments, the humidifier is used to output the reminder message. For example, the reminder message is sent by the humidifier to the terminal via wireless or wired communication, and is then presented by the terminal.

For example, the terminal may communicate with the humidifier via Bluetooth or WiFi. When the water in the tank of the humidifier reaches the required water amount, the reminder message is directly sent from the humidifier to the terminal, and the terminal presents the reminder message to the user. When the user receives the reminder message, the user can stop adding water into the humidifier.

The terminal may be a portable device such as a mobile phone, a tablet computer, or the like. When the terminal receives the reminder message, the terminal can present the reminder message, thereby eliminating the need for a display device on the humidifier, and reducing the cost of the humidifier.

In the exemplary embodiment, the terminal communicating with the humidifier determines the water amount required for the humidifier, and sends the determined water amount to the humidifier. The humidifier automatically detects and controls the amount of water in the humidifier to reach the required water amount, and sends a reminder message back to the terminal. Then the terminal can present the reminder message, thereby reducing the cost of the humidifier.

In exemplary embodiments, the terminal presents the reminder message in a manner of a voice, a graphic, a text, or a vibration.

For example, the terminal may use a speaker of the terminal to play the reminder message in a voice manner, or use a display of the terminal to display the reminder message in a graphic or text form, or use a vibrator of the terminal in a vibration manner to present the reminder message. The reminder message thus can be presented in a variety of ways, which is flexible and convenient for the user to select a preferred manner for use.

Figure 3:
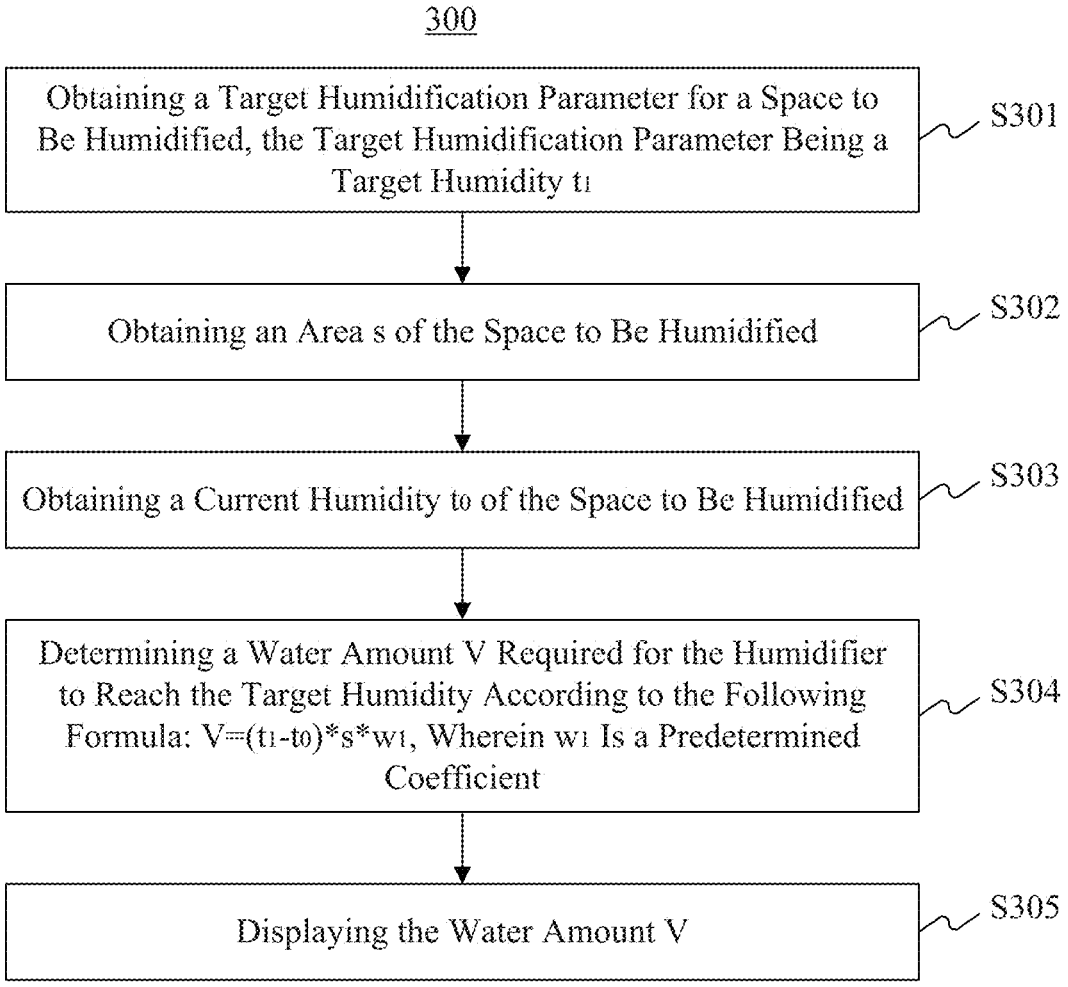
FIG. 3 is a flow diagram of a method for obtaining a water amount for a humidifier in accordance with one exemplary embodiment.

FIG. 3 is a flow diagram of a method 300 for obtaining a water amount for a humidifier in accordance with one exemplary embodiment. For example, the method 300 may be implemented by a humidifier, a terminal or the like. Referring to FIG. 3, the method 300 includes steps S301 to S305.

In step S301, a target humidification parameter for a space to be humidified is obtained, the target humidification parameter being a target humidity $t_1$.

In step S302, an area s of the space to be humidified is obtained.

In step S303, a current humidity t0 of the space to be humidified is obtained.

In step S304, a water amount V required for the humidifier to reach the target humidity is determined according to the following formula: $V=(t_1-t_0)*s*w_1$, wherein $w_1$ is a predetermined coefficient.

In step S305, the water amount V is displayed.

Figure 4:
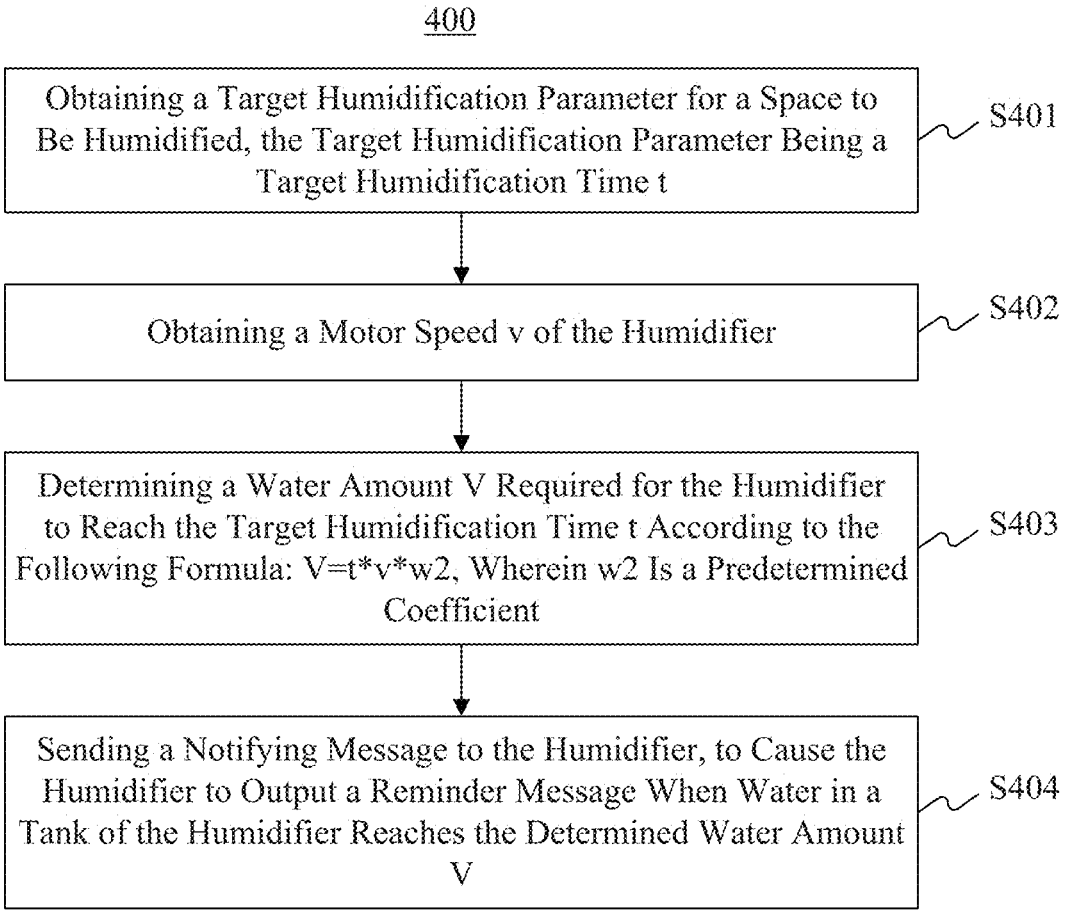
FIG. 4 is a flow diagram of a method for obtaining a water amount for a humidifier in accordance with another exemplary embodiment.

FIG. 4 is a flow diagram of a method 400 for obtaining a water amount for a humidifier in accordance with another exemplary embodiment. For example, the method 400 may be implemented by a terminal or the like. Referring to FIG. 4, the method 400 includes steps S401 to S404.

In step S401, a target humidification parameter for a space to be humidified is obtained, the target humidification parameter being a target humidification time t.

In step S402, a motor speed v of the humidifier is obtained.

In step S403, a water amount V required for the humidifier to reach the target humidification time t is determined according to the following formula: $V=t*v*w_2$, wherein $w_2$ is a predetermined coefficient.

In step S404, a notifying message is sent to the humidifier, to cause the humidifier to output a reminder message when water in a tank of the humidifier reaches the determined water amount V.

Figure 5:
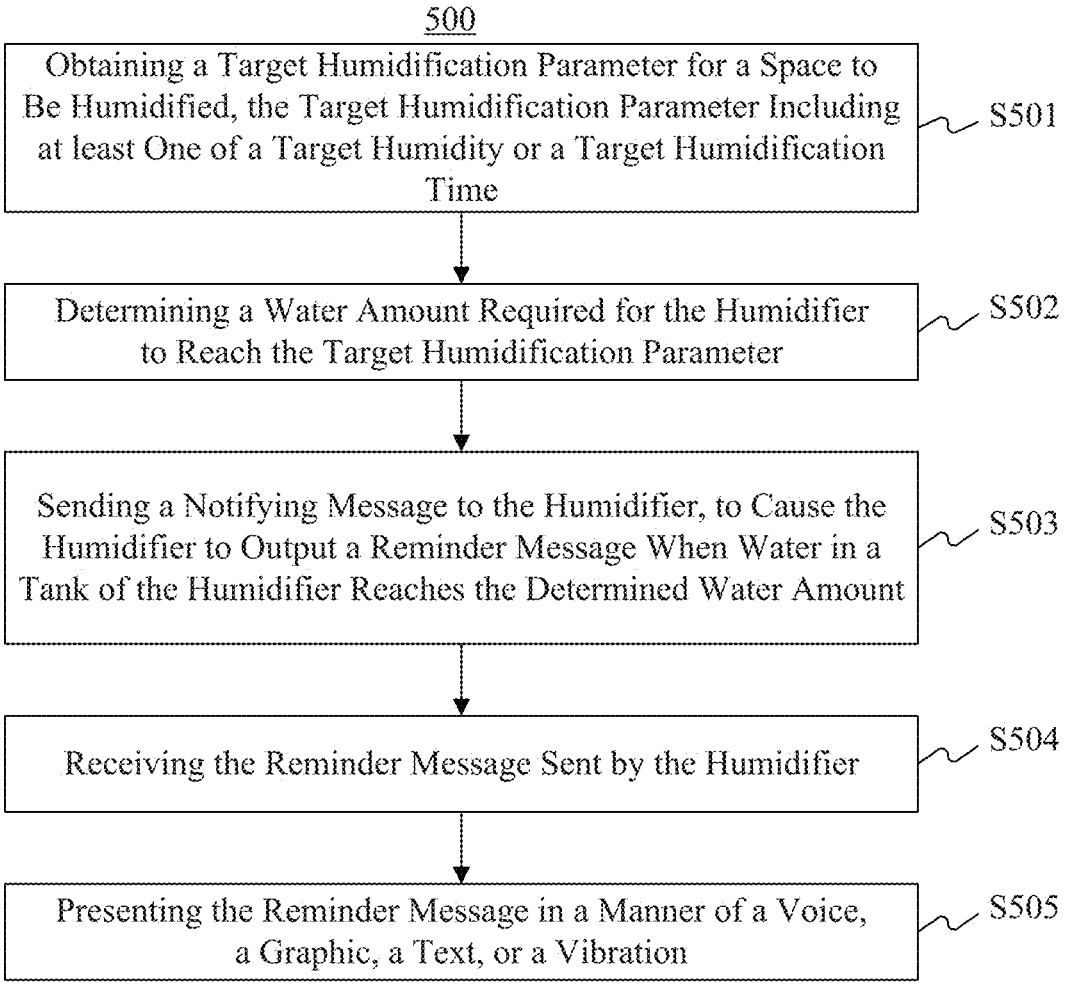
FIG. 5 is a flow diagram of a method for obtaining a water amount for a humidifier in accordance with an exemplary embodiment.

FIG. 5 is a block diagram of a method 500 for obtaining a water amount for a humidifier in accordance with an exemplary embodiment. For example, the method 500 may be implemented by a terminal or the like. Referring to FIG. 5, the method 500 includes steps S501 to S505.

In step S501, a target humidification parameter for a space to be humidified is obtained, the target humidification parameter including at least one of a target humidity or a target humidification time.

In step S502, a water amount required for the humidifier to reach the target humidification parameter is determined.

In step S503, a notifying message is sent to the humidifier, to cause the humidifier to output a reminder message when water in a tank of the humidifier reaches the determined water amount.

In step S504, the reminder message sent by the humidifier is received.

In step S505, the reminder message is presented in a manner of a voice, a graphic, a text, or a vibration.

Figure 6:
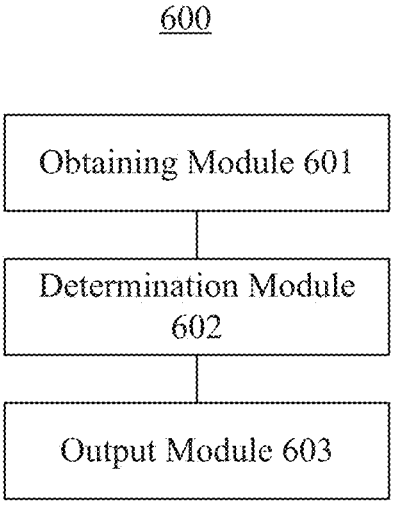
FIG. 6 is a block diagram of a device for obtaining a water amount for a humidifier in accordance with an exemplary embodiment.

FIG. 6 is a block diagram of a device 600 for obtaining a water amount for a humidifier in accordance with an exemplary embodiment. The device 600 may be implemented by software, or hardware, or a combination of both. As shown in FIG. 6, the device 600 includes an obtaining module 601, a determination module 602, and an output module 603.

The obtaining module 601 is configured to obtain a target humidification parameter for a space to be humidified.

The determination module 602 is configured to determine a water amount required for the humidifier to reach the target humidification parameter.

The output module 603 is configured to output a notifying message, the notifying message carrying the water amount.

In an embodiment, the target humidification parameter includes at least one of a target humidity or a target humidification time.

Figure 7:
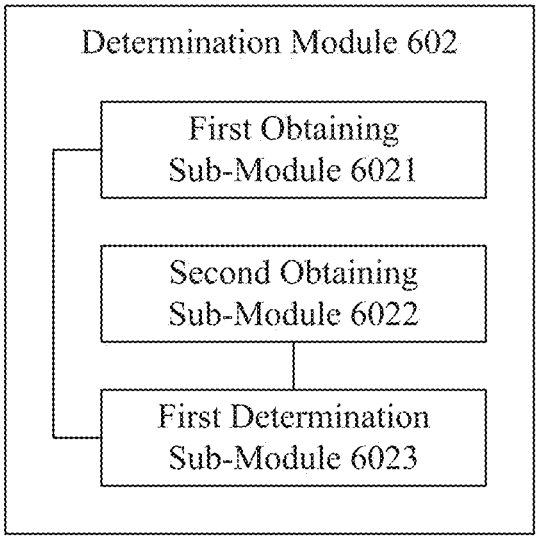
FIG. 7 is a block diagram of a determination module for obtaining a water amount for a humidifier in accordance with an exemplary embodiment.

In an embodiment, as shown in FIG. 7, when the target humidification parameter is the target humidity, the determination module 602 includes a first obtaining sub-module 6021, a second obtaining sub-module 6022, and a first determination sub-module 6023.

The first obtaining sub-module 6021 is configured to obtain an area of the space to be humidified.

The second obtaining sub-module 6022 is configured to obtain a current humidity of the space to be humidified.

The first determination sub-module 6023 is configured to determine the water amount required for the humidifier to reach the target humidity in accordance with the space area, the current humidity, and the target humidity of the space to be humidified.

In an embodiment, the first determination sub-module 6023 is configured to determine the water amount required for the humidifier to reach the target humidity according to the following formula: $V=(t_1-t_0)*s*w_1$, wherein V is the determined water amount, $t_1$ is the target humidity, $t_0$ is the current humidity, s is the area, and $w_1$ is a predetermined coefficient.

Figure 8:
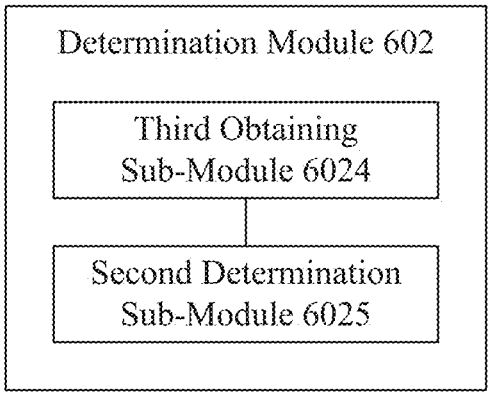
FIG. 8 is a block diagram of a determination module for obtaining a water amount for a humidifier in accordance with an exemplary embodiment.

In an embodiment, as shown in FIG. 8, when the target humidification parameter is the target humidification time, the determination module 602 includes a third obtaining sub-module 6024 and a second determination sub-module 6025.

The third obtaining sub-module 6024 is configured to obtain a motor speed of the humidifier.

The second determination sub-module 6025 is configured to determine the water amount required for the humidifier to reach the target humidification time in accordance with the motor speed and the target humidification time.

In an embodiment, the second determination sub-module 6025 is configured to determine the water amount required for the humidifier to reach the target humidification time according to the following formula: $V=t*v*w_2$, wherein V is the determined water amount, t is the target humidification time, v is the motor speed, and $w_2$ is a predetermined coefficient.

Figure 9:
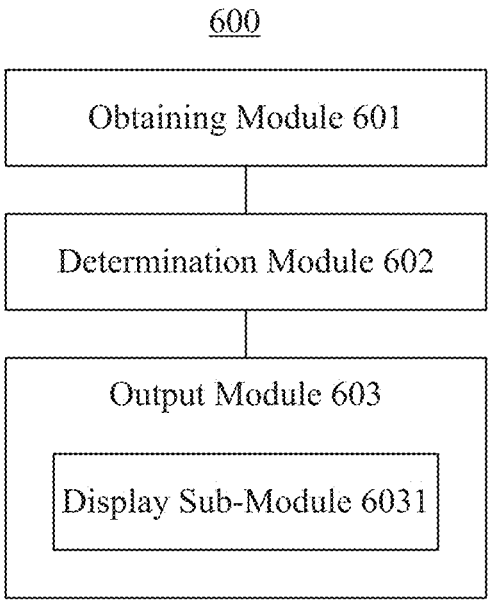
FIG. 9 is a block diagram of a device for obtaining a water amount for a humidifier in accordance with an exemplary embodiment.

In an embodiment, as shown in FIG. 9, the output module 603 includes a display sub-module 6031.

The display sub-module 6031 is configured to display the determined water amount.

Figure 10:
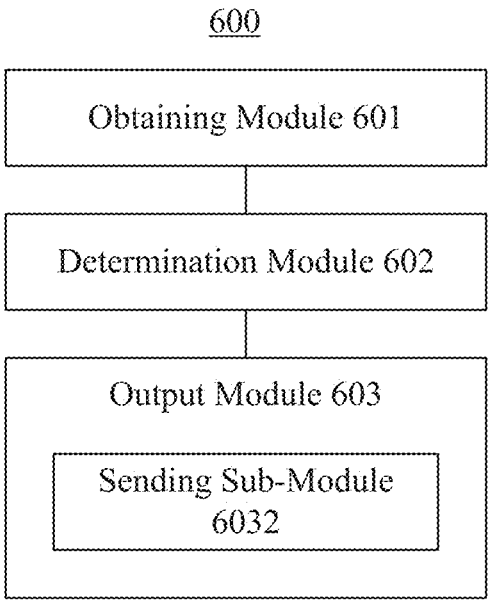
FIG. 10 is a block diagram of a device for obtaining a water amount for a humidifier in accordance with an exemplary embodiment.

In an embodiment, as shown in FIG. 10, the output module 603 includes a sending sub-module 6032.

The sending sub-module 6032 is configured to send the notifying message to the humidifier, to cause the humidifier to output a reminder message when water in a tank of the humidifier reaches the determined water amount.

Figure 11:
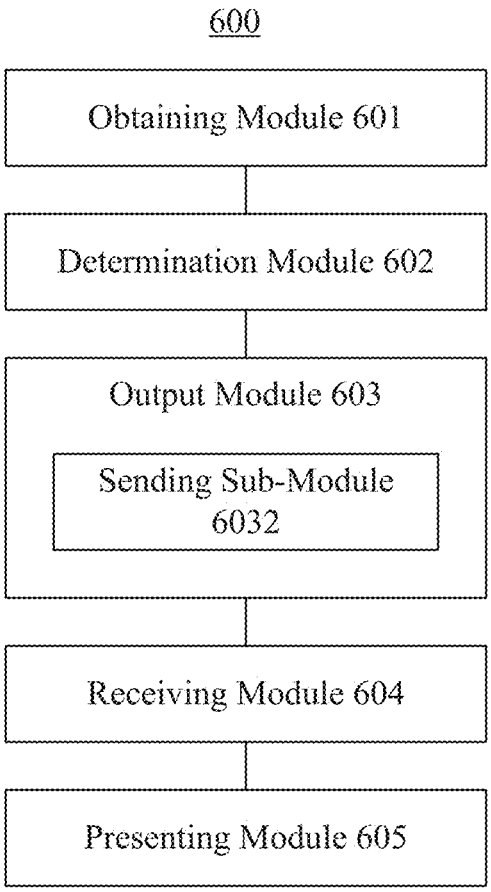
FIG. 11 is a block diagram of a device for obtaining a water amount for a humidifier in accordance with an exemplary embodiment.

In an embodiment, as shown in FIG. 11, the device 600 further includes a receiving module 604 and a presenting module 605.

The receiving module 604 is configured to receive the reminder message sent by the humidifier.

The presenting module 605 is configured to present the reminder message.

Figure 12:
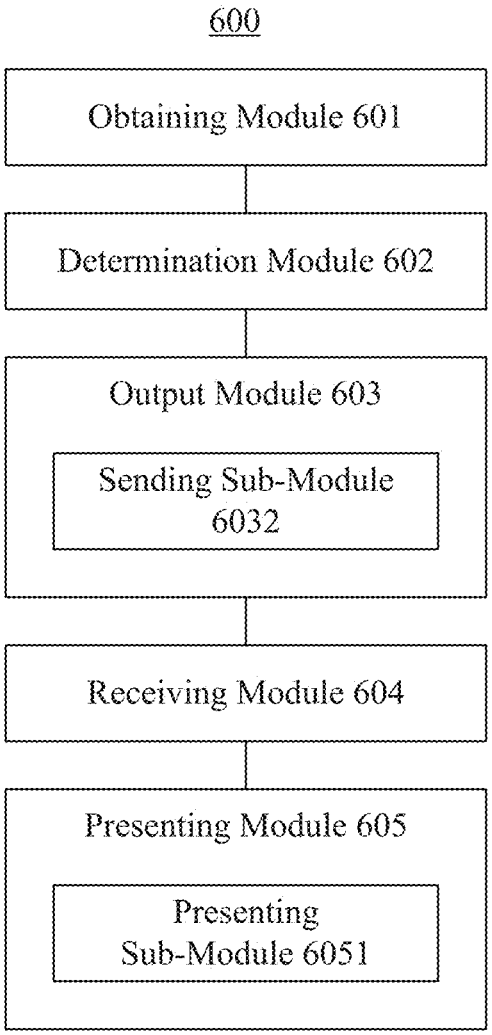
FIG. 12 is a block diagram of a device for obtaining a water amount for a humidifier in accordance with an exemplary embodiment.

In an embodiment, as shown in FIG. 12, the presenting module 605 includes a presenting sub-module 6051.

The presenting sub-module 6051 is configured to present the reminder message in a manner of a voice, a graphic, a text, or a vibration.

With respect to the device in the above embodiment, the concrete manner in which each module performs the operation has been described in detail in the method embodiments, and will not be repeated herein.

Figure 13:
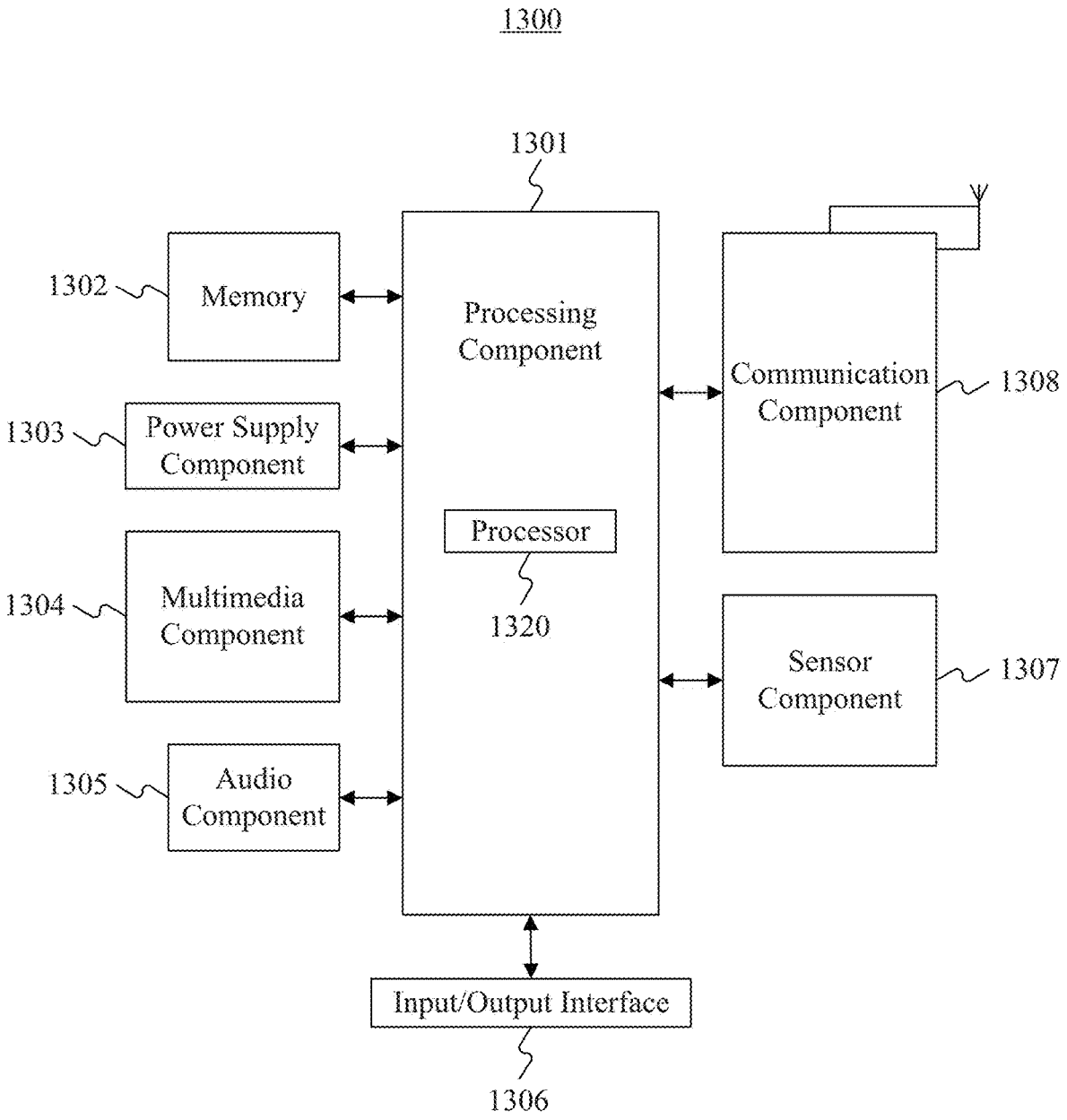
FIG. 13 is a block diagram of a device for obtaining a water amount for a humidifier in accordance with an exemplary embodiment.

FIG. 13 is a block diagram of a device 1300 for obtaining a water amount for a humidifier in accordance with an exemplary embodiment. For example, the device 1300 may be a mobile phone, a gaming console, a computer, a tablet, a personal digital assistant, and the like.

The device 1300 may include one or more of the following components: a processing component 1301, a memory 1302, a power supply component 1303, a multimedia component 1304, an audio component 1305, an input/output (I/O) interface 1306, a sensor component 1307, and a communication component 1308.

The processing component 1301 typically controls overall operations of the device 1300, such as the operations associated with display, telephone calls, data communications, camera operations, and recording operations. The processing component 1301 may include one or more processors 1320 to execute instructions to perform all or part of the steps in the above described methods. Moreover, the processing component 1301 may include one or more modules which facilitate the interaction between the processing component 1301 and other components. For instance, the processing component 1301 may include a multimedia module to facilitate the interaction between the multimedia component 1304 and the processing component 1301.

The memory 1302 is configured to store various types of data to support the operation of the device 1300. Examples of such data include instructions for any applications or methods operated on the device 1300, contact data, phonebook data, messages, pictures, video, etc. The memory 1302 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power supply component 1303 provides power to various components of the device 1300. The power supply component 1303 may include a power management system, one or more power sources, and any other components associated with the generation, management, and distribution of power in the device 1300.

The multimedia component 1304 includes a screen providing an output interface between the device 1300 and the user. In some embodiments, the screen may include a liquid crystal display (LCD) and a touch panel. If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a duration and a pressure associated with the touch or swipe action. In some embodiments, the multimedia component 1304 includes a front camera and/or a rear camera. The front camera and the rear camera may receive external multimedia data while the device 1300 is in an operation mode, such as a photographing mode or a video mode. Each of the front camera and the rear camera may be a fixed optical lens system or have focus and optical zoom capability.

The audio component 1305 is configured to output and/or input audio signals. For example, the audio component 1305 includes a microphone configured to receive an external audio signal when the device 1300 is in an operation mode, such as a calling mode, a recording mode, and a voice recognition mode. The received audio signal may be further stored in the memory 1302 or transmitted via the communication component 1308. In some embodiments, the audio component 1305 further includes a speaker to output audio signals.

The I/O interface 1306 provides an interface between the processing component 1301 and peripheral interface modules, such as a keyboard, a click wheel, buttons, and the like. The buttons may include, but are not limited to, a home button, a volume button, a starting button, and a locking button.

The sensor component 1307 includes one or more sensors to provide status assessments of various aspects of the device 1300. For instance, the sensor component 1307 may detect an active/inactive status of the device 1300, relative positioning of components, e.g., the display and the keypad, of the device 1300, a change in position of the device 1300 or a component of the device 1300, a presence or absence of user contact with the device 1300, an orientation or an acceleration/deceleration of the device 1300, and a change in temperature of the device 1300. The sensor component 1307 may include a proximity sensor configured to detect the presence of nearby objects without any physical contact. The sensor component 1307 may also include a light sensor, such as a CMOS or CCD image sensor, for use in imaging applications. In some embodiments, the sensor component 1307 may also include an accelerometer sensor, a gyroscope sensor, a magnetic sensor, a pressure sensor, or a temperature sensor.

The communication component 1308 is configured to facilitate wired or wireless communication between the device 1300 and other devices. The device 1300 can access a wireless network based on a communication standard, such as WiFi, 2G, 3G, or 4G, or a combination thereof. In one exemplary embodiment, the communication component 1308 receives a broadcast signal or broadcast associated information from an external broadcast management system via a broadcast channel. In one exemplary embodiment, the communication component 1308 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 1300 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer-readable storage medium including instructions, such as included in the memory 1302, executable by the processor 1320 in the device 1300, for performing the above-described methods. For example, the non-transitory computer-readable storage medium may be a ROM, a RAM, a CD-ROM, a magnetic tape, a floppy disc, an optical data storage device, and the like.

Figure 14:
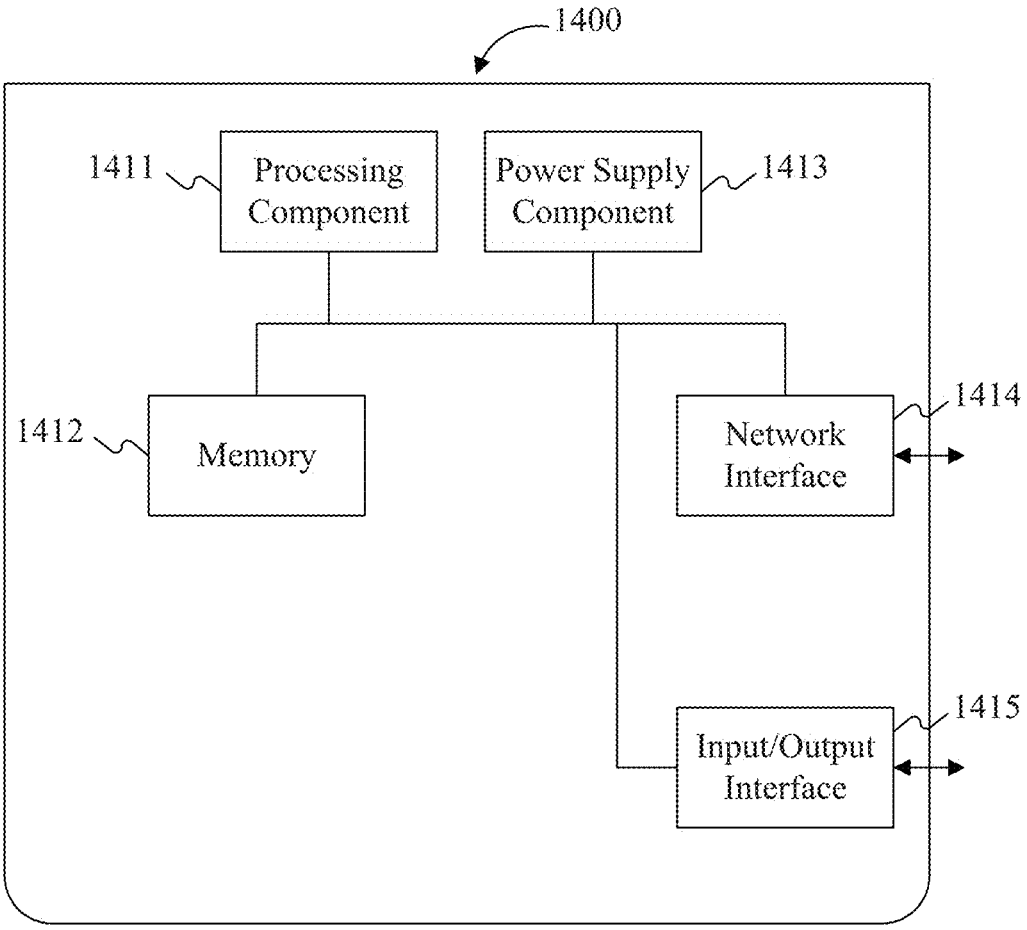
FIG. 14 is a block diagram of a device for obtaining a water amount for a humidifier in accordance with an exemplary embodiment.

FIG. 14 is a block diagram of a device 1400 for obtaining a water amount for a humidifier in accordance with an exemplary embodiment. For example, the device 1400 may be provided as a humidifier. The device 1400 includes a processing component 1411 that further includes one or more processors, and memory resources represented by a memory 1412 for storing instructions executable by the processing component 1411, such as application programs. The application programs stored in the memory 1412 may include one or more sets of instructions. Further, the processing component 1411 is configured to execute the instructions to perform the above methods.

The device 1400 may also include a power supply component 1413 configured to perform power management of the device 1400, wired or wireless network interface(s) 1414 configured to connect the device 1400 to a network, and an input/output (I/O) interface 1415. The device 1400 may operate based on an operating system stored in the memory 1412, such as Windows Server™, Mac OS X™, Unix™, Linux™, FreeBSD™, or the like.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present invention is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. A method for determining a water amount for a humidifier, comprising:

obtaining, by a terminal device in wireless communication with the humidifier, a target humidification parameter for a space to be humidified;

determining, by the terminal device, a water amount required for the humidifier to reach the target humidification parameter;

outputting a notifying message via a user interface provided by the terminal device, the notifying message carrying the determined water amount; and sending, by the terminal device, the notifying message to the humidifier, to cause the humidifier to output a reminder message when water in a tank of the humidifier reaches the determined water amount.

2. The method of claim 1, wherein the target humidification parameter comprises at least one of a target humidity of the space to be humidified or a target humidification time.

3. The method of claim 2, wherein when the target humidification parameter is the target humidity, the determining of the water amount comprises:

obtaining an area and a current humidity of the space to be humidified; and determining the water amount required for the humidifier to reach the target humidity in accordance with the area, the current humidity, and the target humidity of the space to be humidified.

4. The method of claim 3, wherein the determining of the water amount in accordance with the area, the current humidity, and the target humidity of the space to be humidified comprises:

determining the water amount required for the humidifier to reach the target humidity according to the following formula: $V=(t_1-t_0)*s*w_1$, wherein V is the determined water amount, $t_1$ is the target humidity, $t_0$ is the current humidity, s is the area, and $w_1$ is a predetermined coefficient.

5. The method of claim 2, wherein when the target humidification parameter is the target humidification time, the determining of the water amount comprises:

obtaining a motor speed of the humidifier; and determining the water amount required for the humidifier to reach the target humidification time in accordance with the motor speed and the target humidification time.

6. The method of claim 5, wherein the determining of the water amount in accordance with the motor speed and the target humidification time comprises:

determining the water amount required for the humidifier to reach the target humidification time according to the following formula: $V=t*v*w_2$, wherein V is the determined water amount, t is the target humidification time, v is the motor speed, and $w_2$ is a predetermined coefficient.

7. The method of claim 1, wherein the outputting of the notifying message comprises:

displaying the determined water amount.

8. The method of claim 1, further comprising:

receiving, by the terminal device, the reminder message sent by the humidifier; and presenting, by the terminal device, the reminder message.

9. The method of claim 8, wherein the presenting of the reminder message comprises:

presenting the reminder message in a manner of a voice, a graphic, a text, or a vibration.

10. A device for determining a water amount for a humidifier, the device being in wireless communication with the humidifier, the device comprising:

a processor; and a memory for storing instructions executable by the processor, wherein the processor is configured to:

obtain a target humidification parameter for a space to be humidified;

determine a water amount required for the humidifier to reach the target humidification parameter;

output a notifying message via a user interface provided by the device, the notifying message carrying the determined water amount; and send the notifying message to the humidifier, to cause the humidifier to output a reminder message when water in a tank of the humidifier reaches the determined water amount.

11. The device of claim 10, wherein the target humidification parameter comprises at least one of a target humidity of the space to be humidified or a target humidification time.

12. The device of claim 11, wherein when the target humidification parameter is the target humidity, the processor is further configured to:

obtain an area and a current humidity of the space to be humidified; and determine the water amount required for the humidifier to reach the target humidity in accordance with the area, the current humidity, and the target humidity of the space to be humidified.

13. The device of claim 12, wherein the processor is further configured to:

determine the water amount required for the humidifier to reach the target humidity according to the following formula: $V=(t_1-t_0)*s*w_1$, wherein V is the determined water amount, $t_1$ is the target humidity, $t_0$ is the current humidity, s is the area, and $w_1$ is a predetermined coefficient.

14. The device of claim 11, wherein when the target humidification parameter is the target humidification time, the processor is further configured to:

obtain a motor speed of the humidifier; and determine the water amount required for the humidifier to reach the target humidification time in accordance with the motor speed and the target humidification time.

15. The device of claim 14, wherein the processor is further configured to:

determine the water amount required for the humidifier to reach the target humidification time according to the following formula: $V=t*v*w_2$, wherein V is the determined water amount, t is the target humidification time, v is the motor speed, and $w_2$ is a predetermined coefficient.

16. The device of claim 10, wherein the processor is further configured to:

display the determined water amount.

17. The device of claim 10, wherein the processor is further configured to:

receive the reminder message sent by the humidifier; and present the reminder message via the user interface provided by the device.

18. A non-transitory computer-readable storage medium having stored therein instructions that, when executed by a processor of a device in wireless communication with a humidifier, cause the device to perform a method for determining a water amount for the humidifier, the method comprising:

obtaining, by the device, a target humidification parameter for a space to be humidified;

determining, by the device, a water amount required for the humidifier to reach the target humidification parameter;

outputting a notifying message via a user interface provided by the device, the notifying message carrying the determined water amount; and sending, by the device, the notifying message to the humidifier, to cause the humidifier to output a reminder message when water in a tank of the humidifier reaches the determined water amount.

* * * * *